US010248046B2

(12) United States Patent
Shirakata et al.

(10) Patent No.: US 10,248,046 B2
(45) Date of Patent: Apr. 2, 2019

(54) IMAGE FORMING APPARATUS

(71) Applicant: CANON KABUSHIKI KAISHA, Tokyo (JP)

(72) Inventors: Jiro Shirakata, Chigasaki (JP); Tadashi Fukuda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 20 days.

(21) Appl. No.: 15/415,220

(22) Filed: Jan. 25, 2017

(65) Prior Publication Data

US 2017/0227887 A1 Aug. 10, 2017

(30) Foreign Application Priority Data

Feb. 9, 2016 (JP) ..... 2016-023019

(51) Int. Cl.

| | |
|---|---|
| ***G03G 15/08*** | (2006.01) |
| ***G03G 15/043*** | (2006.01) |
| ***G03G 15/00*** | (2006.01) |

(52) U.S. Cl.

CPC ..... *G03G 15/0856* (2013.01); *G03G 15/043* (2013.01); *G03G 15/5058* (2013.01); *G03G 15/5062* (2013.01); *G03G 15/55* (2013.01)

(58) Field of Classification Search

CPC ..... G03G 15/0856; G03G 15/043; G03G 15/5058; G03G 15/5062; G03G 15/55

USPC ..... 358/521

See application file for complete search history.

(56) References Cited

U.S. PATENT DOCUMENTS 8,335,441 B2 12/2012 Kubo et al.
2016/0070198 A1* 3/2016 Morinaga ..... G03G 15/553 399/27

* cited by examiner

*Primary Examiner* — Houshang Safaipour
(74) *Attorney, Agent, or Firm* — Venable LLP

(57) ABSTRACT

An image forming apparatus comprises a controller, an adjustment unit configured to adjust an image forming condition based on an adjustment condition corresponding to a profile of a toner adhesion amount in a sheet conveying direction, and an image forming unit configured to form an image on a sheet with the adjusted image forming condition while conveying the sheet.

6 Claims, 8 Drawing Sheets

IMAGE FORMING APPARATUS

BACKGROUND OF THE INVENTION

Field of the Invention

The present disclosure relates to an image forming apparatus which forms an image on a sheet.

Description of the Related Art

In an image forming apparatus using electrophotographic technology, a charger charges a photoreceptor, an exposure unit exposes the photoreceptor to form an electrostatic latent image on the photoreceptor, and a developing device develops the electrostatic latent image using toner. The toner image formed in this manner is then transferred to a sheet and fixed on the sheet by a fixing device.

In the image forming method as mentioned, in a case where a toner charge amount in the developing device, a transfer voltage for transferring the toner image or the like is varied in each of the above steps, a density of an output image may vary. Then, a technology which controls an image forming condition for adjusting the density of the output image based on the toner amount supplied to the developing device and the toner amount consumed from the developing device is known (Please see U.S. Pat. No. 8,335,441).

The image forming apparatus disclosed in the U.S. Pat. No. 8,335,441 predicts a variation of the toner charge amount in the developing device based on the toner consumption amount, the toner supply amount and stirring time by a screw in the developing device. Then, based on the predicted variation amount of the charge amount in the developing device, the image forming apparatus controls the image forming condition.

The image forming apparatus disclosed in the U.S. Pat. No. 8,335,441 can correct a variation of image density caused by the variation of the toner charge amount in the developing device. However, it was incapable of correcting the image density variation due to a cause other than the variation of the toner charge amount in the developing device.

A description is provided in a case where an image D1, an image D2, and an image D3 are formed in parallel on one sheet. The image D1 is an image of high density. The image D2 is an image of low density. The image D3 is an image whose density is lower than the image D1 and higher than the image D2. FIG. 8 is a diagram showing a density transition of the image D3 in a conveying direction of the sheet. Each of the images D1, D2, and D3 is formed based on different image signal values. For example, the image signal value for forming the image D1 is 255, the image signal value for forming the image D2 is 10, and the image signal value for forming the image D3 is 100. A result shown in FIG. 8 was obtained by measuring the density of the image D3 using a densitometer by an inventor at one or more positions of different conveying directions.

It is obvious from a lower drawing of FIG. 8 that the image density of an intermediate density portion (image D3) is varied at a boundary between a high density portion (image D1) and a low density portion (image D2). This is the image density variation caused by a transfer current variation caused by a toner adhesion amount in a transfer nip. It is noted that the image forming apparatus as disclosed in the U.S. Pat. No. 8,335,441 cannot treat the density variation which promptly reacts to the variation of the toner adhesion amount in the conveying direction.

SUMMARY OF THE INVENTION

An image forming apparatus according to the present disclosure includes: a conversion unit configured to convert an image signal value included in image data based on a conversion condition; an adjustment unit configured to adjust the converted image signal value based on an adjustment condition; an image forming unit configured to form an image using toner based on the image signal value adjusted by the adjustment unit, and transfer the image to a sheet while conveying the sheet; a measurement unit configured to measure a measurement image on the sheet; and a controller configured to control the image forming unit to form a measurement image on the sheet based on measurement image data, to control the measurement unit to measure the measurement image, and to generate the adjustment condition based on a measurement result of the measurement image, wherein the adjustment unit is further configured to generate a profile of a toner adhesion amount in a sheet conveying direction based on the image signal value, and to adjust the converted image signal value based on the adjustment condition corresponding to the profile.

Further features of the present invention will become apparent from the following description of exemplary embodiments (with reference to the attached drawings).

DESCRIPTION OF THE EMBODIMENTS

In the following, an exemplary embodiment of an image forming apparatus applying the present disclosure is explained in detail using drawings.

Image Forming Apparatus and Image Forming Operation

An image forming apparatus 10 according to the present embodiment forms an electrostatic latent image on an image carrier such as a photoreceptor, a dielectric and the like by an electrophotographic system, an electrostatic recording system and the like. The image forming apparatus 10 then develops and transfers the electrostatic latent image to form a visible image on a sheet. Thereby, the present disclosure can be applied to the image forming apparatus having such a configuration or an equal configuration.

Figure 1:
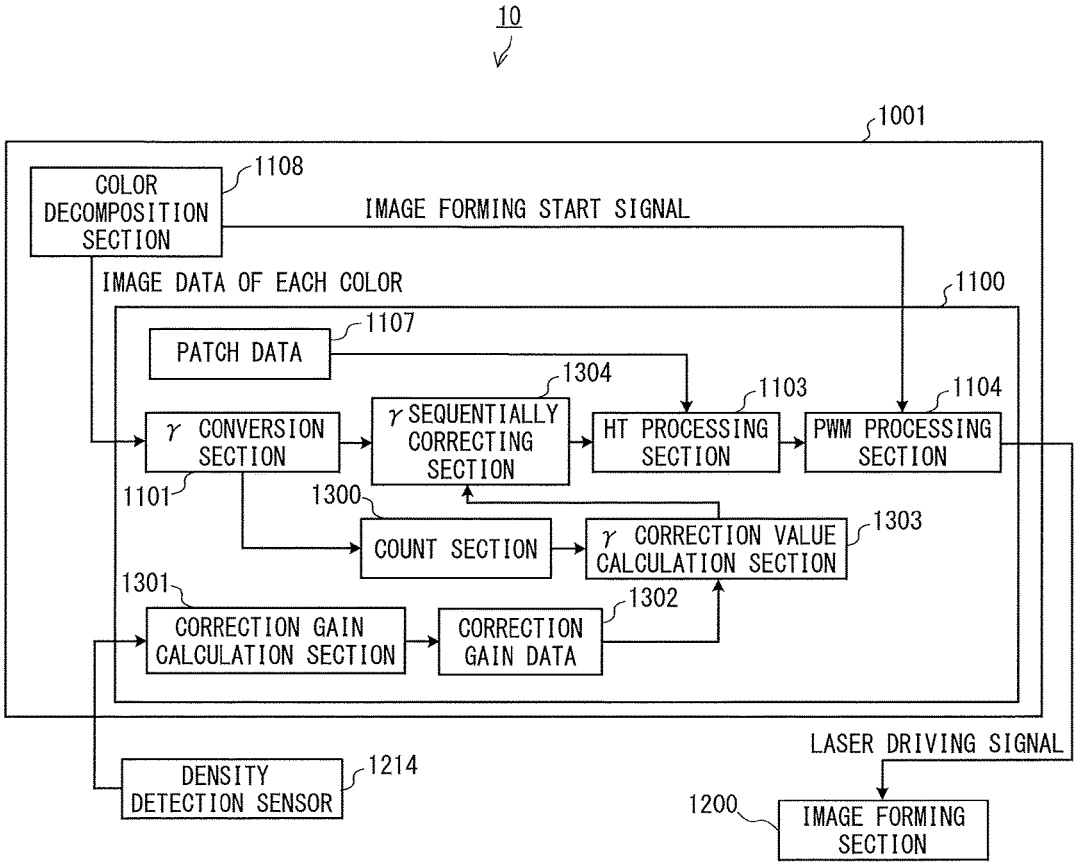
FIG. 1 is a functional block diagram for controlling each unit of an image forming apparatus.
Figure 2:
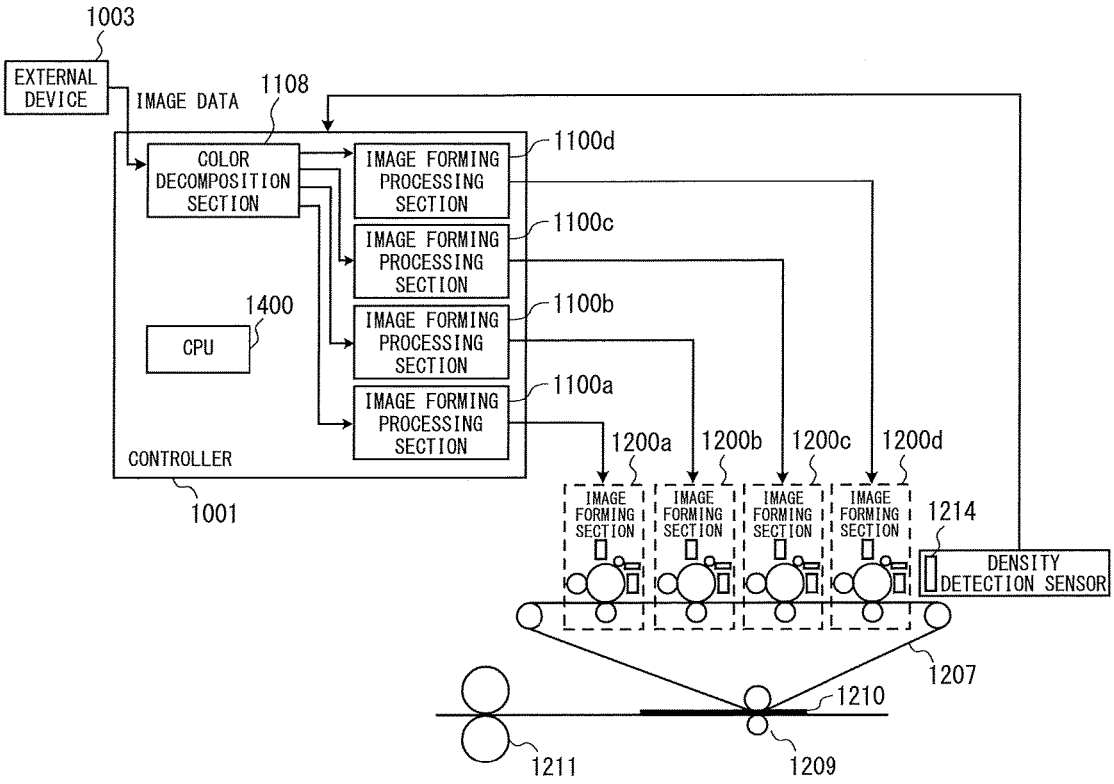
FIG. 2 is a schematic diagram for explaining an overall configuration of the image forming apparatus.
Figure 3:
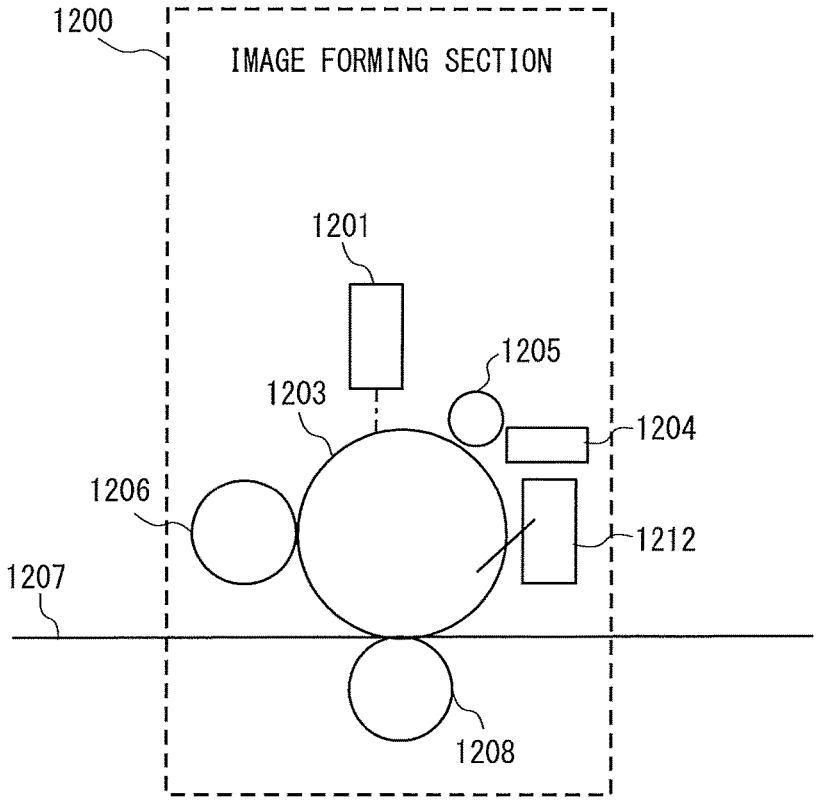
FIG. 3 is a schematic diagram of an essential part of an image forming section.

FIGS. 1, 2, and 3 are diagrams for illustrating configuration examples of the electrophotographic image forming apparatus, which are diagrams for explaining outline of the image forming apparatus 10. FIG. 1 is a functional block diagram of a controller 1001 for controlling each unit of the image forming apparatus 10. FIG. 2 is a schematic diagram for explaining an overall configuration of the image forming apparatus 10. FIG. 3 is a schematic diagram of an essential part of an image forming section.

The image forming apparatus 10 shown in FIG. 10 comprises the controller 1001 for performing image processing to image data, an image forming section 1200 for forming an image based on the image data, and a density detection sensor 1214. Also, the image forming apparatus 10 is communicably connected to an external device 1003 shown in FIG. 2. Details of the external device 1003 will be described later.

The controller 1001 comprises a color decomposition section 1108, an image processing section 1100, and a CPU (Central Processing Unit) 1400 (see FIG. 2). The image processing section 1100 comprises a γ conversion section 1101, a HT processing (Half Tone processing) section 1103, a PWM processing section 1104, patch data 1107 stored in a recording section (not shown), a count section 1300, and a correction gain calculation section 1301. The image processing section 1100 also comprises correction gain data 1302 stored in a recording section (not shown), a γ correction value calculation section 1303, and a γ sequentially correcting section 1304.

The controller 1001 as shown in FIG. 2 mainly controls image forming operation of the image forming apparatus 10. The controller 1001 receives image data transferred from the external device 1003 and issues a print instruction (job) in accordance with the received image data. It is noted that the external device 1003 is a device such as a computer, a server, a scanner or the like, which is a device to output various information including image data for image formation.

The image data input to the controller 1001 is decomposed into each color component through the color decomposition section 1108. The image data decomposed into each color component is output to the image processing section 1100. In particular, the image data decomposed into each color component is output to image forming processing sections 1100*a*, 1100*b*, 1100*c*, and 1100*d* which function as an image processing unit for each color. Then, laser driving signal after PWM pulse width modulation processing performed in the image processing section 1100 (described later) is output to the image forming section 1200 (image forming sections 1200*a*, 1200*b*, 1200*c*, and 1200*d* corresponding to each color) which functions as the image forming unit.

Images of each color are transferred to an intermediate transfer belt 1207 from each of the image forming sections 1200*a*, 1200*b*, 1200*c*, and 1200*d* at the same timing. Then, full-color toner image is formed on the intermediate transfer belt 1207. The full-color toner image is transferred to a sheet 1210 (for example, paper) by a secondary transfer device 1209. The secondary transfer device 1209 includes a transfer roller which presses the intermediate transfer belt 1207. This forms a transfer nip portion between the intermediate transfer belt 1207 and the transfer roller. The secondary transfer device 1209 forms the transfer nip portion for transferring the image on the intermediate transfer belt 1207 to the sheet 1210. The sheet 1210 is conveyed by the transfer roller while passing the transfer nip portion. Then, using a potential difference between the transfer roller and the intermediate transfer belt 1207, the secondary transfer device 1209 transfers the image on the intermediate transfer belt 1207 to the sheet 1210 at the transfer nip portion. The sheet 1210 to which the full-color toner image is transferred is then conveyed to a fixing device 1211. The toner image is then fixed on the sheet 1210 by the fixing device 1211. The sheet 1210 on which the toner image is fixed is then delivered outside the image forming apparatus 10. In the following, detail of the image forming section 1200 is explained using FIG. 3. It is noted that the image forming sections 1200*a*, 1200*b*, 1200*c*, and 1200*d* are in the same configuration. Thereby, for convenience, in FIG. 3, only an image forming section for one color is shown as the image forming section 1200.

The image forming section 1200 comprises a laser diode 1201, a photosensitive drum 1203 as an image carrier, an exposure unit 1204, a charger 1205, a developing device (developing section) 1206, a primary transfer device 1208, and a cleaner 1212. Also, the intermediate transfer belt 1207 is arranged between the photosensitive drum 1203 and the primary transfer device 1208.

In response to the laser driving signal, the laser diode 1201 emits laser beam. The emitted laser beam is irradiated on the rotating photosensitive drum 1203 through a polygon mirror (not shown), a fθ lens (not shown), and a reflection mirror (not shown). In this manner, an electrostatic latent image is formed on the photosensitive drum 1203.

After electricity is uniformly removed by the exposure device 1204, the photosensitive drum 1203 is uniformly charged by the charger 1205. Thereafter, by receiving the laser beam irradiation from the laser diode 1201, the electrostatic latent image in accordance with a print image is formed on the photosensitive drum 1203. The electrostatic latent image is then developed by toner supplied from the developing device (developing section) 1206 as a visible image (toner image). At this time, a DC bias component in accordance with an electrostatic latent image forming condition and an AC bias component for improving developing efficiency are superposed and applied to the developing device 1206.

The developed toner image is transferred, through the primary transfer device 1208, to the belt-like intermediate transfer belt 1207 which is stretched between one or more rollers and is endlessly driven. It is noted that residual toner remaining on the photosensitive drum 1203 is scraped and recovered by the cleaner 1212.

Image Processing Operation

Figure 4:
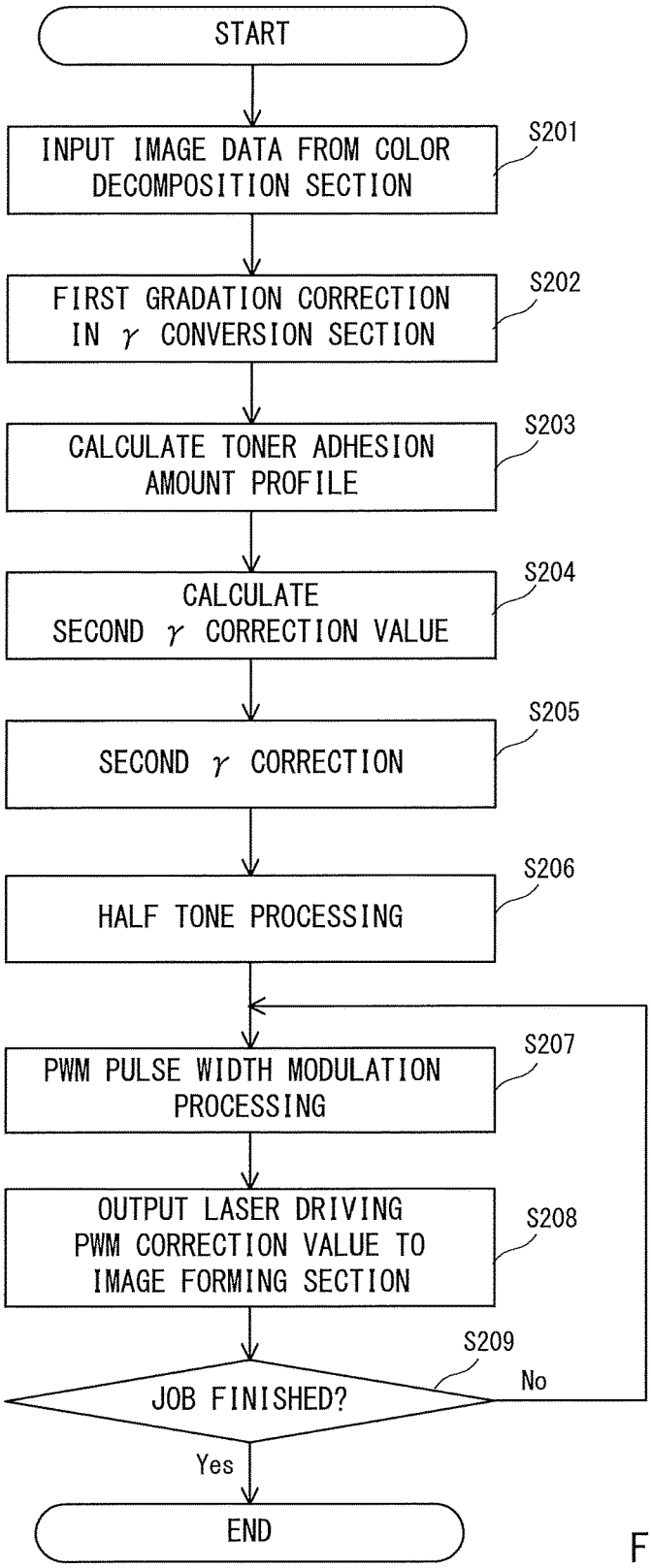
FIG. 4 is a flowchart for explaining image forming operation.

FIG. 4 is a flowchart for explaining the image forming operation of the image forming apparatus 10. It is noted that each processing shown in FIG. 4 is mainly executed by a CPU 1400 provided with the controller 1001. Processing procedure is explained with reference to FIG. 1.

When receiving the image data from the external device 1003, the CPU 1400 inputs the image data of each color to the γ conversion section 1101 through the color decomposition section 1108 (Step S201). The CPU 1400 converts the image signal value of the image data using a lookup table (LUT) through the γ conversion section 1101 (Step S202). To correct a density characteristic (gradation characteristic) of the image formed by the image forming apparatus 10 to an ideal density characteristic, the γ conversion section 1101 converts the image signal value with reference to the lookup table. It is noted that the γ conversion section 1101 converts the image signal value based on the lookup table for each color. It means that the lookup table exists for each color. In the following, in the Step S202, processing to convert the image signal value performed by the γ conversion section 1101 based on the lookup table is described as a first gradation correction. The count section 1300 counts the image signal value. Based on the image signal value counted using the count section 1300, the CPU 1400 derives a toner adhesion amount distribution profile (Step S203). The toner adhesion amount distribution profile means data indicating relation with a position on a sheet and a toner amount adhered to the position.

Figure 5:
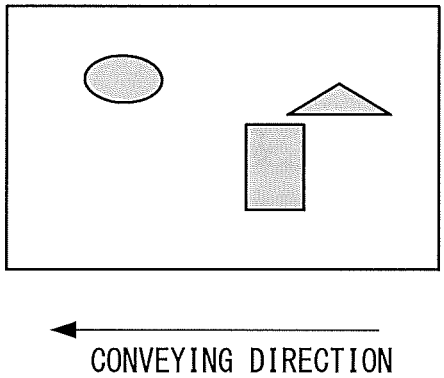
FIG. 5 is a diagram for explaining an image transferred to a sheet and a profile of a toner adhesion amount corresponding to the image.
Figure 5:
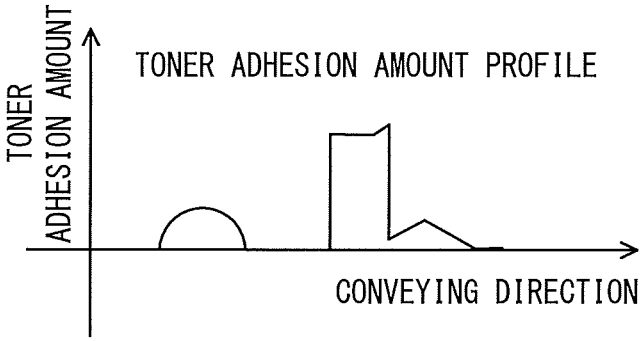

Here, a description is provided with regard to the toner adhesion amount distribution profile. FIG. 5 is a diagram for explaining a profile representing a distribution of the toner adhesion amount for one line in the image to be transferred to the sheet. It is noted that "one line" corresponds to a width for one pixel in a conveying direction of the sheet and a region corresponding to a full width of the sheet in a direction which is orthogonal to the conveying direction. The profile of the toner adhesion amount is, as shown in FIG. 5, a function representing the distribution of the toner adhesion amount in a conveying direction of the image (sum of the image signal value for each color). In a case where the sum of the image signal value of yellow, the image signal value of magenta, the image signal value of cyan, and the image signal value of black increases, the toner adhesion amount accordingly increases. In a case where the sum of the image signal value of yellow, the image signal value of magenta, the image signal value of cyan, and the image signal value of black decreases, the toner adhesion amount accordingly decreases. A value of the toner adhesion amount in a position (j) in the conveying direction is computed, as shown in an expression 1 below, using a signal value n (i, j) of each pixel consisting of a pixel for one page.

$$VC(j)=n(1,j)+n(2,j)+n(3,j)+\ldots+n(w,j) \quad \text{Expression (1)}$$

It is noted that "j" represents a pixel number in the conveying direction and "i" represents a pixel number in the direction which is orthogonal to the conveying direction. "n(i, j)" represents the sum of the image signal value for each color in a pixel.

Referring again to the explanation of FIG. 4, the CPU 1400 causes the γ correction value calculation section 1303 to multiply the sum of the image signal value for one line obtained from the count section 1300 by correction gain to derive a γ correction value for one line (Step S204). The CPU 1400 sends the derived γ correction value to the sequentially correcting section 1304. In the sequentially correcting section 1304, by multiplying the image signal to which the first gradation correction is performed in the γ conversion section 1101 by the γ correction value, a second gradation correction is performed. As mentioned, the CPU 1400 and the sequentially correcting section 1304 function as an adjustment unit which adjusts the image signal value after the conversion in accordance with the toner adhesion amount in the direction which is orthogonal to the conveying direction of the sheet. The CPU 1400 performs the second gradation correction. In the second gradation correction, the CPU 1400 changes the image signal value at a predetermined position in a conveying direction of the image (Step S205). With the second gradation correction, it becomes possible to perform proper density correction to the density variation of the output image which promptly reacts to the variation of the toner amount which passes the transfer nip portion.

The CPU 1400 sends the image signal after the second gradation correction performed through the sequentially correcting section 1304 to the HT processing section 1103 to perform half tone processing (HT processing) through the HT processing section (Step S206).

The CPU 1400 performs the PWM pulse width modulation processing. In the PWM pulse width modulation processing, the CPU 1400 compares an image signal with a triangular wave signal of a predetermined cycle through the PWM processing section 1104 (Step S207). Here, the image signal is synchronized with the image forming start signal which is sent from the color decomposition section and a counter, starting from the image forming start signal as a start point, and to which, the half tone processing is applied. Then, the CPU 1400 sequentially outputs a laser driving signal after the PWM pulse width modulation processing to the image forming section 1200 (Step S208). Thereafter, the CPU 1400 determines whether or not a series of jobs is finished (Step S209). In a case where it is determined that the series of jobs is finished (Step S209: Yes), the CPU 1400 ends the processing. In a case where it is determined that the series of jobs is not finished (Step S209: No), the CPU 1400 returns to the processing of the Step S207.

Through the series of control processing as mentioned, it is possible to use the laser driving signal for the image formation. The laser signal is a signal to which the proper image density correction processing is applied to the density variation which quickly reacts to the toner adhesion amount variation in the conveying direction. With this, the image signal value is corrected based on the profile of the toner adhesion amount in one page. As a result, the image forming apparatus can form a high quality image in which the variation of the image density caused by the variation of the toner adhesion amount is suppressed.

Correction Gain Adjustment Mode

On the other hand, in the density variation which promptly reacts to the variation of the toner adhesion amount in the above conveying direction, magnitude of the variation is changed due to a resistance change caused by durability of the primary transfer device 1208 and the like. Thereby, the image forming apparatus 10 according to the present embodiment comprises a correction gain adjustment mode through which the magnitude of the variation is detected for a predetermined number of sheets to obtain proper correction gain. In the following, a description is provided with regard to the correction gain adjustment mode on the basis of FIG. 6.

Figure 6:
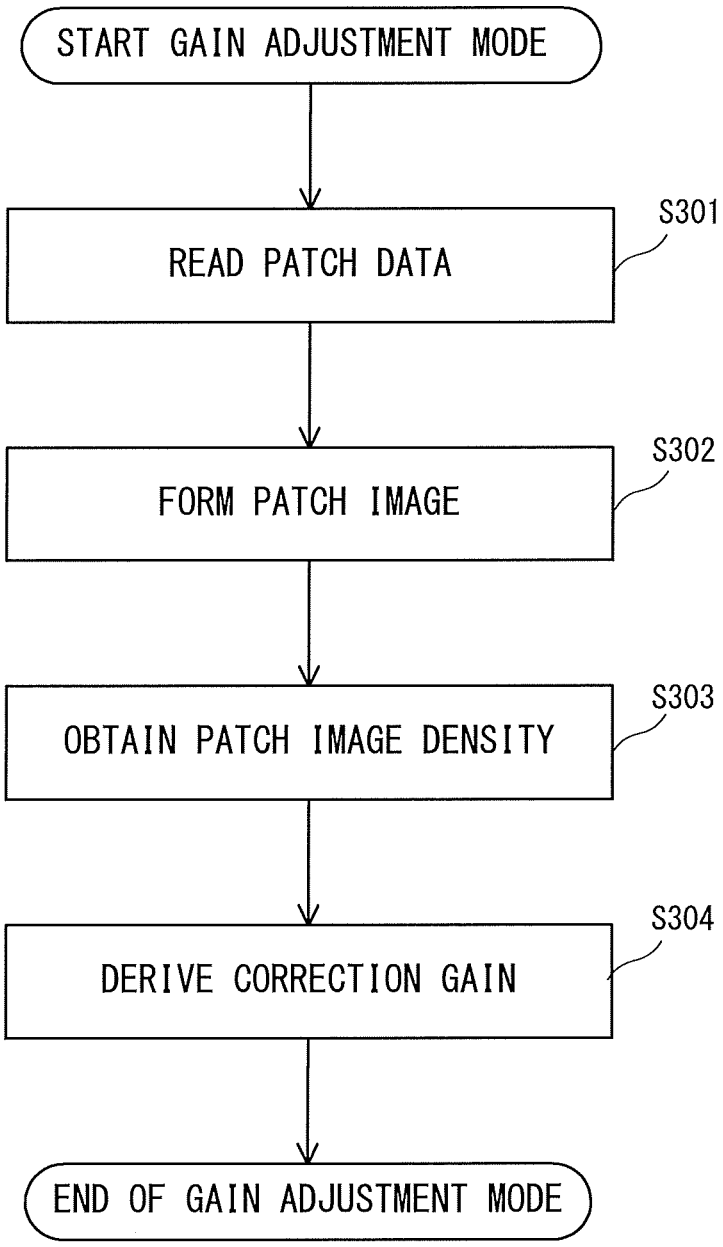
FIG. 6 is a flowchart of a correction gain adjustment mode.

FIG. 6 is a flowchart for explaining operation of the correction gain adjustment mode. It is noted that each processing shown in FIG. 6 is mainly executed by the CPU 1400 provided with the controller 1001.

When an image is formed (image formation is performed) on a predetermined number of sheets or when an instruction is given from a user, the CPU 1400 starts the correction gain adjustment mode.

The CPU 1400 reads the patch data 1107 stored in a predetermined recording section (Step S301) and sends the read patch data 1107 to the HT processing section 1103. The CPU 1400 forms a test image (patch image) on the basis of the patch data 1107 on the intermediate transfer belt 1207 through the HT processing section 1103 (Step S302). The patch image is a measurement image formed for obtaining the γ correction value (gain). The patch data 1107 is patch image data for forming the patch image.

Figure 7:
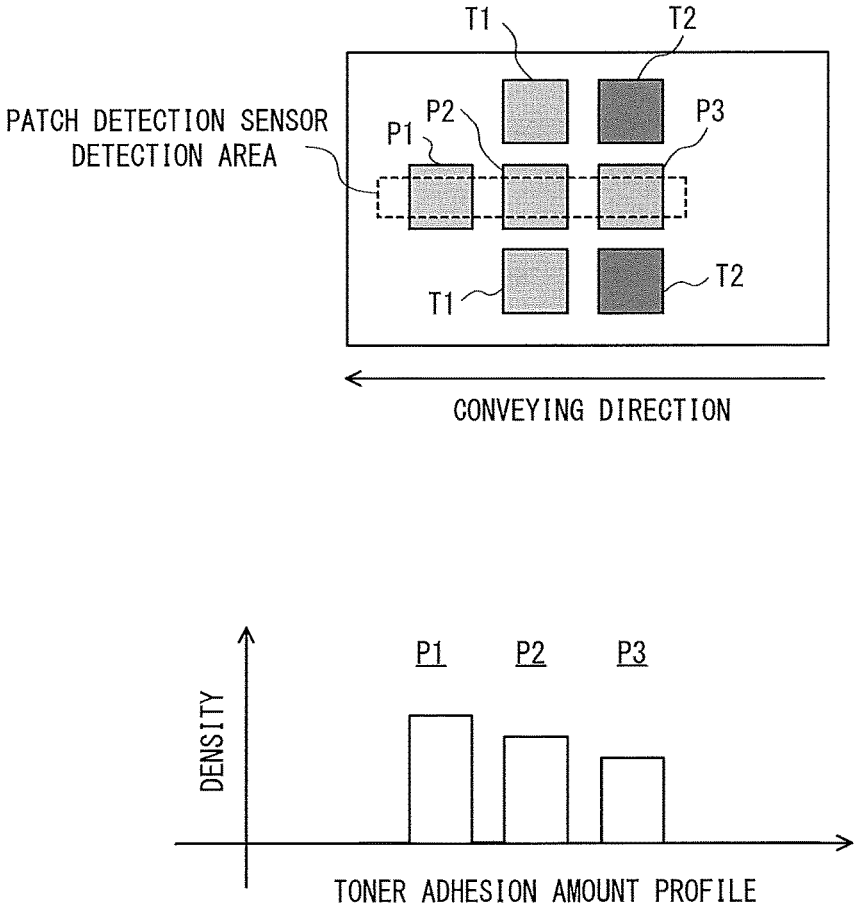
FIG. 7 is a schematic diagram of a patch image formed in the correction gain adjustment mode and a profile of the toner adhesion amount relating to the patch image.
Figure 8:
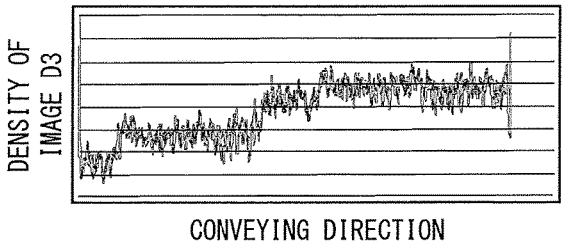
FIG. 8 is a diagram for explaining the image density variation which occurs in a conventional art.
Figure 8:
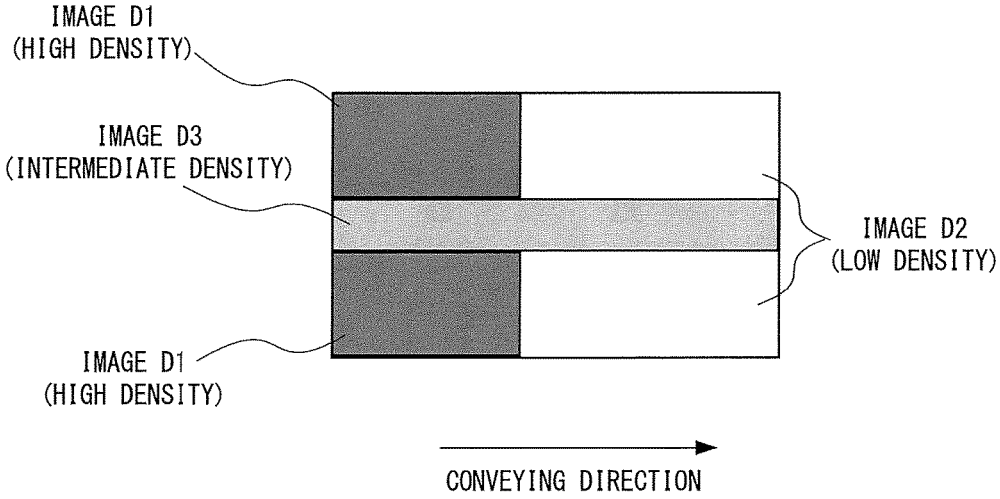

Here, a description is provided with regard to the patch image using FIG. 7. FIG. 7 is a diagram for explaining the patch image which is formed in the correction gain adjustment mode and the toner adhesion amount distribution profile to the image. As shown in FIG. 7, the patch image includes test images P1, P2, and P3 formed at different positions in the conveying direction. The patch image also includes test images T1 formed in the direction which is orthogonal to the conveying direction to interpose the test image P2 therebetween. The patch image also includes test images T2 formed in the direction which is orthogonal to the conveying direction to interpose the test image P3 therebetween. Further, the test images P1, P2, and P3 are formed based on the same image signal value. It means that the test images P1, P2, and P3 are the images of the same density. It is noted that the density of the test image T1 is lower than that of the test image T2.

Further, the test images T1 and T2 are formed at positions that do not pass in a detection area of the density detection sensor 1214, i.e., they are formed outside the detection area. Thereby, the test images T1 and T2 are not detected by the density detection sensor 1214. The test image P1 is not interposed between the other test images, T1 and T2.

Further, as the test image P2 is interposed between the test images T1, the toner adhesion amount of the test image P2 may differ from the toner adhesion amount of the test image P1. Likewise, as the test image P3 is interposed between the test images T2, the toner adhesion amount of the test image P3 may differ from the toner adhesion amount of the test image P1. Further, as the toner adhesion amount of the test image T1 differs from the toner adhesion amount of the test image T2, the toner adhesion amount of the test image P3 may differ from the toner adhesion amount of the test image P2. By obtaining a ratio of the adhesion amount of the test images P1, P2, and P3, the CPU 1400 can determine the correction gain (coefficient). It is noted that, in the present embodiment, instead of obtaining the ratio of the toner adhesion amount, density is measured.

Back to FIG. 6, the CPU 1400 obtains the image density of the patch image formed on the intermediate transfer belt 1207 through the density detection sensor 1214 which functions as an image density detection unit (Step S303). It is noted that even in a case where the obtained image density (patch density data) is found to be the same density, as shown in FIG. 7, it is influenced on the toner adhesion amount distribution profile of the patch image.

The CPU 1400 compares the obtained patch density data with the toner adhesion amount distribution profile of the patch and derives the proper correction gain based on the comparison result to adjust the correction value through the correction gain calculation section 1301 (Step S304). It is noted that the derived correction gain is stored in a recording section (not shown) as the correction gain data 1302. By performing linear interpolation of the density of the patch images P1, P2, and P3, the CPU 1400 can obtain the γ correction value (gain) in accordance with the profile of the direction which is orthogonal to the conveying direction.

With the series of control processing, by adapting the correction gain to the image forming operation as mentioned, it is always possible to perform the image density correction processing by the proper toner adhesion amount distribution profile. Thereby, a high quality image can be obtained. As mentioned, the image forming apparatus 10 according to the present embodiment corrects the image signal value based on the profile of the toner adhesion amount in one page. Thereby, the image forming apparatus 10 can form a high quality image in which the variation of the image density caused by the variation of the toner adhesion amount is suppressed.

It is noted, in the present embodiment, that the explanatory description has been provided in a case where, based on the toner adhesion amount distribution profile, the image density is controlled using the γ correction table. Other than this, even when a laser PWM processing section, a transfer voltage control section and the like are used, as long as the controller can change the image forming condition in the conveying direction of the image, it is possible to apply the present disclosure.

Various controls in the present embodiment may be performed, for example, by a MPU (Micro-Processing Unit), and an ASIC (Application Specific Integrated Circuit), a SoC (System-on-a-Chip) and the like to realize some functions of the controller 1001.

The above embodiments are only the examples to specifically explain the present invention. Therefore, the scope of the invention is not limited to these embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-023019, filed Feb. 9, 2016 which is hereby incorporated by reference herein in its entirety.

What is claimed is:

1. An image forming apparatus comprising:

an image processor configured to convert an image signal value included in image data based on a conversion condition;

an image former configured to form an image using toner based on the converted image signal value, and transfer the image to a sheet while conveying the sheet;

a sensor configured to measure a measurement image on the sheet; and a controller configured to:

control a process condition to form the image by the image former, control the image former to form a measurement image on the sheet based on measurement image data, control the sensor to measure the measurement image, and generate a control amount for controlling the process condition based on a measurement result of the measurement image, wherein the controller is further configured to generate a profile of a toner adhesion amount in a sheet conveying direction based on the image signal value to control the process condition based on the control amount corresponding to the profile, wherein the controller is further configured to perform a first gradation correction to an image signal through γ conversion and to derive a toner adhesion amount distribution of the image signal to which the first gradation correction is applied, and wherein the controller is further configured to perform a second gradation correction by multiplying the image signal to which the first gradation correction is applied by a correction value which is derived based on the toner adhesion amount distribution and which varies in the sheet conveying direction.

2. An image forming apparatus comprising:

an image former configured to form an image using toner based on an image signal and to transfer, during conveyance of a sheet, the image onto the sheet; and a controller, having an image processor, configured to:

determine, by accumulating a toner adhered amount of a toner image to be formed on the sheet in a direction orthogonal to the sheet conveying direction, profile data concerning a relation between a position on the sheet in the conveying direction and a toner adhesion amount;

control the image processor to execute image processing in which the image signal is corrected based on the profile data, wherein, the image former is configured to form, in a case where the image is to be formed on the sheet, the image based on the image signal to which the image processing was executed by the image processor.

3. The image forming apparatus according to claim 2, wherein the controller is configured to determine a correction gain based on the profile data, and wherein the image processor is configured to correct, in the image processing, the image signal based on the correction gain.

4. The image forming apparatus according to claim 2, further comprising:

an image carrier on which a measurement image is formed by the image former; and a sensor configured to measure the measurement image on the image carrier;

wherein the controller is configured to determine a correction gain based on the profile data and the measurement result of the sensor, and wherein the image processor is configured to correct, in the image processing, the image signal based on the correction gain.

5. The image forming apparatus according to claim 2, further comprising:

an image carrier on which a measurement image is formed by the image former; and a sensor configured to measure the measurement image on the image carrier, wherein the controller is configured to control the image former to form the measurement image, the controller is configured to control the sensor to measure the measurement image, the controller is configured to determine the correction gain based on the profile data and the measurement result of the sensor, and the image processor is configured to correct, in the image processing, the image signal based on the correction gain.

6. The image forming apparatus according to claim 2, further comprising:

an image carrier configured to rotate; and a sensor configured to measure the measurement image on the image carrier, wherein the controller is configured to control the image former to form the measurement image, first images, and second images on the image carrier, the controller is configured to control the sensor to measure the measurement image on the image carrier, the controller is configured to determine a correction gain based on the profile data and the measurement result of the sensor, the image processor is configured to correct, in the image processing, the image signal based on the correction gain, the first images are formed to interpose a first area of the measurement image therebetween in a direction orthogonal to a rotating direction of the image carrier, the second images are formed to interpose a second area of the measurement image therebetween in the direction orthogonal to the rotating direction of the image carrier, the first area is different from the second area in the rotating direction of the image carrier, and a density of the first images is different from that of the second images.

* * * * *